United States Patent [19]

Yamana

[11] Patent Number: 4,577,540

[45] Date of Patent: Mar. 25, 1986

[54] ELECTRONIC MUSICAL INSTRUMENT HAVING A PAN-POT FUNCTION

[75] Inventor: Kozi Yamana, Tokyo, Japan

[73] Assignee: Casio Computer Co., Ltd., Tokyo, Japan

[21] Appl. No.: 726,168

[22] Filed: Apr. 22, 1985

Related U.S. Application Data

[63] Continuation of Ser. No. 530,028, Sep. 7, 1983.

[30] Foreign Application Priority Data

Sep. 9, 1982 [JP] Japan ..... 57-157044

[51] Int. Cl.[4] ..... G10H 1/02

[52] U.S. Cl. ..... 84/1.27; 381/1

[58] Field of Search ..... 84/1.27, 1.26, 1.24, 84/1.01, 1.03; 381/1

[56] References Cited

U.S. PATENT DOCUMENTS 4,240,317 12/1980 Kmetz ..... 84/1.01
4,423,655 1/1984 Turner ..... 84/1.24

FOREIGN PATENT DOCUMENTS 1407152 7/1972 United Kingdom .
1549292 7/1976 United Kingdom .
2008904 11/1978 United Kingdom .
2031638 9/1979 United Kingdom .

OTHER PUBLICATIONS

Handbuch der Tonstudiotechnik, 4. Auflage 1979, S. 489–491.

*Primary Examiner*—Forester W. Isen
*Attorney, Agent, or Firm*—Frishauf, Holtz, Goodman & Woodward

[57] ABSTRACT

Digital pan-pot data supplied from a CPU is supplied to first and second analog multiplexers, and control signals are selected among a plurality of control signals obtained by dividing an output from a reference voltage generator to have mutually complementary relationship, are supplied from the first and second analog multiplexers through low-pass filters to control signal input terminals of first and second VCAs. An output of the first VCA is supplied to a right loudspeaker as an R-channel musical signal, and an output of the second VCA is supplied to a left loudspeaker as an L-channel musical sound signal, respectively.

4 Claims, 3 Drawing Figures

ELECTRONIC MUSICAL INSTRUMENT HAVING A PAN-POT FUNCTION

This application is a continuation, of application Ser. No. 530,028, filed Sept. 7, 1983.

BACKGROUND OF THE INVENTION

This invention relates to an electronic musical instrument having a pan-pot function.

When a musical tone signal generated from a musical tone generator is transmitted to two VCAs (voltage controlled amplifiers) and two musical tone signals which are output from these VCAs are transmitted to two loudspeakers which are separated, musical sound is heard as if it were generated from the intermediate position between the two loudspeakers if the ratios of the levels of such musical tone signals obtained from the VCAs are set to 1:1. On the other hand, if the ratio of the output levels of two VCAs is set to, for example, 7:3, the musical sound is stronger in the direction of the loudspeaker with the musical tone signal corresponding to 7. In this way, the method for hearing the musical sound from a predetermined position between two loudspeakers by properly setting the volume ratios of the musical sounds to be generated from two loudspeakers can be accomplished and is known as pan-pot. In conventional electronic musical instruments, a method exists of performing pan-pot by controlling the two VCAs by providing two volume control signals which are generated from a single control voltage generator and the mutual level ratios are kept constant. In addition, there is also a method of accomplishing the pan-pot in which one volume control signal is selectively generated from a plurality of control voltage generators to control two VCAs using this volume control signal.

However, both of the above conventional sound image localization systems or pan-pot systems have no appeal to electronic musical instrument users, since the sound image can not be localized freely and correctly at a fixed location, and sound variation is poor.

SUMMARY OF THE INVENTION

It is therefore an object of the present invention to provide an electronic musical instrument having a pan-pot function, wherein sound image localization can be freely and securely changed in accordance with, for example, timbre and pitch of an output musical sound, and the sound image localization is not affected by a sound volume varying apparatus, and wherein the total volume of sounds generated from each loudspeaker can be freely changed.

According to the present invention, the above object is accomplished by an electronic musical instrument comprising sound image localization means which includes: switching means for selectively outputting first and second control signals among a plurality of preset control signals in accordance with sound image localization information the first and second control signals being mutually complementary; first volume variation means to be controlled he first control signal; and second volume variation means to be controlled by the second control signal, whereby the sound image localization of the sound is controlled using this sound image localization means on the basis of the sound image localization information.

DETAILED DESCRIPTION OF THE PREFERRED EMBODIMENT

Figure 1:
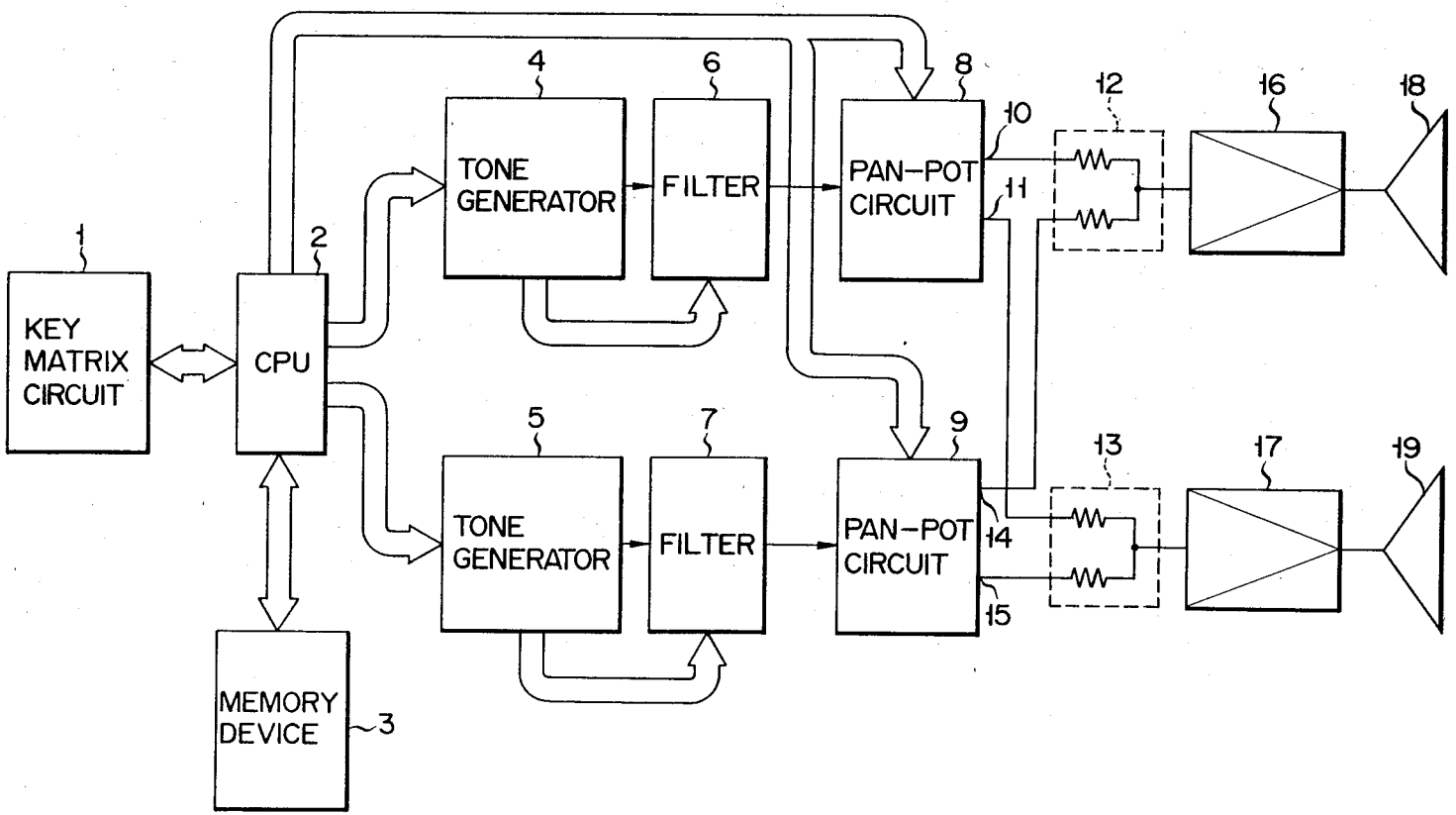
FIG. 1 is a block diagram of an embodiment of the present invention.

An embodiment of the present invention will now be described in detail with reference to the drawings. An electronic musical instrument of this embodiment has a casing (not shown), in which circuit components shown in FIG. 1 are accommodated. This casing is provided at its upper surface with a keyboard for performance, a tone color setting key, a volume setting key, an arpeggio key, a pan-pot key, etc. These keys are coupled to each matrix switch located in a key matrix circuit 1, and the turn-on and turn-off of each key are read out by the key scan operation of a CPU 2. A memory device 3 is coupled to the CPU 2. This memory device 3 includes a RAM and musical data of melody, chord, etc. that has been taken into the CPU 2 by the operation of the keyboard is stored in this RAM. The musical data stored in the RAM is read out by the CPU 2 in accordance with the operation of an automatic play key provided, for example, on the upper surface of the casing and is utilized for automatic performance. In addition, control data to allow the pan-pot to be changed according to time lapse, change in tone color, or arpeggio, or other data are also stored.

The musical data that has been transmitted from the key matrix circuit 1 or memory device 3 to the CPU 2 is then sent from the CPU 2 to tone generators 4 and 5, where two kinds of tone signals are produced, respectively. For instance, a tone signal generated from the tone generator 4 is transmitted next to a filter 6, where a tone signal having a tone color of a piano is produced. On the other hand, a tone signal produced from the tone generator 5 is sent to a filter 7, where the tone signal is modified to have a tone color of a violin. The tone signals passed through the filters 6 and 7 are respectively supplied to PAN-POT circuits 8 and 9 for pan-pot. The operations of these PAN-POT circuits 8 and 9 are controlled on the basis of pan-pot information signals sent from the CPU 2, respectively. The musical tone signal with the piano tone which has been transmitted to the PAN-POT circuit 8 is divided into a right channel signal 10 and a left channel signal 11, and these signals are supplied to one input terminal of mixers 12 and 13, respectively. At this time, the ratio of the volumes of the signals 10 and 11 is set to, for example, 7:3. The tone signal having the tone color of the violin which has been sent to the PAN-POT circuit 9 is divided into a right channel signal 14 and a left channel signal 15, and these signals are supplied to the other input terminals of the mixers 12 and 13, respectively. On the other hand, the volume ratio of the signals 14 and 15 is inversely set to 3:7, for example. The tone signals each containing piano and violin colors mixed by the mixers 12 and 13 are amplified by amplifiers 16 and 17, respectively, and then supplied to loudspeakers 18 and 19. Thus, each loudspeaker 18, 19 generates a musical sound in which piano and violin sounds are mixed. As a result, the sound image or a piano is localized near the right loudspeaker 18 since the volume of piano sound generated from the right loudspekaer 18 is larger than the left one. The sound image of violin, however, is localized to the location near the left loudspeaker 19.

Figure 2:
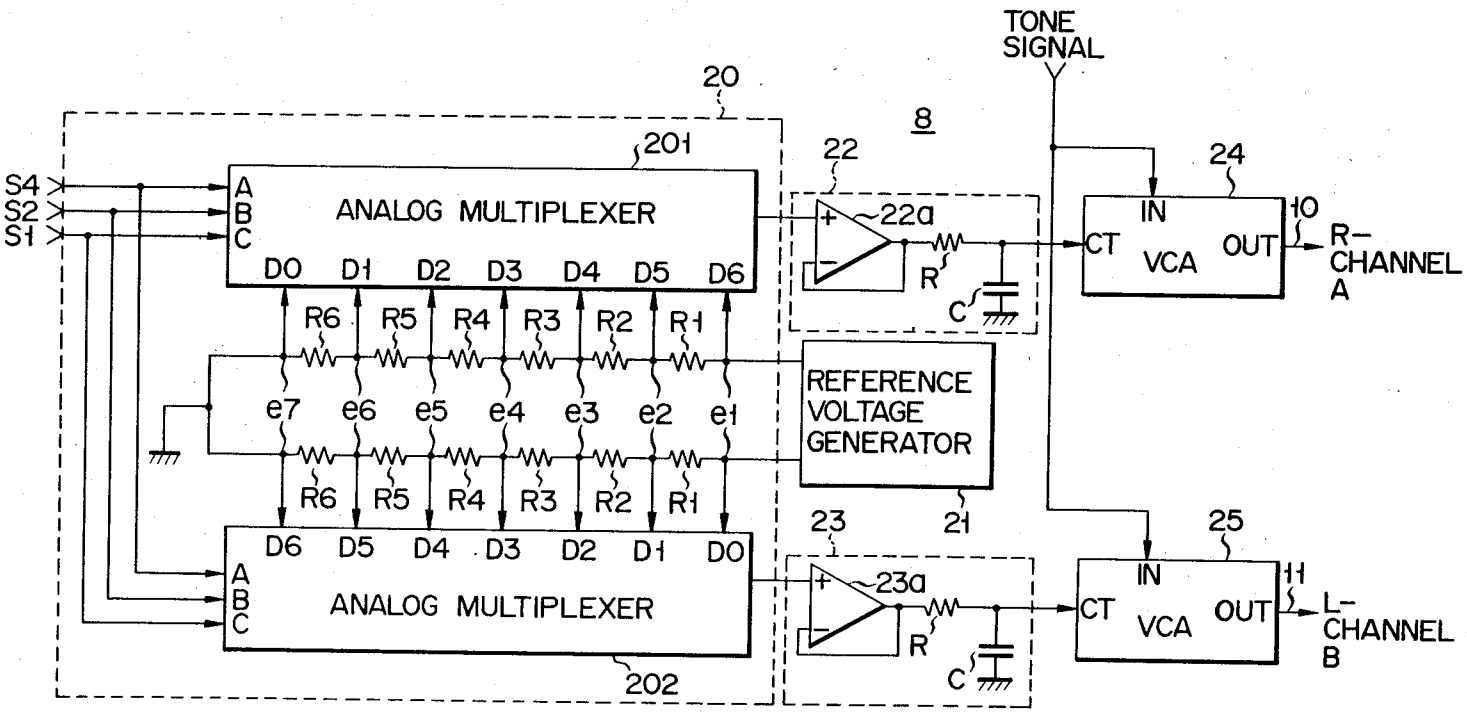
FIG. 2 is a block diagram showing an arrangement of a PAN-POT. circuit in FIG. 1.

FIG. 2 shows a concrete circuit diagram showing the construction of the PAN-POT circuit 8. The PAN-POT circuit 9 has a similar arrangement; only the PAN-POT circuit 8 is shown here. In the drawing, 3-bit pan-pot data S4, S2 and S1 supplied from the CPU 2 is commonly applied to 3-bit input terminals A, B and C of each of two analog multiplexers 201 and 202 which are included in a control voltage generator 20. Each of the analog multiplexers 201 and 202 has seven input terminals D0, D1, D2, D3, D4, D5 and D6. An output voltage e1 from a reference voltage generator 21 is applied to the input terminal D6 of the multiplexer 201 and to the input terminal D0 of the multiplexer 202, respectively. A voltage divider having series connected resistors R1, R2, R3, R4, R5 and R6 is connected between the input terminal D6 of the multiplexer 201 and the ground, and each dividing point thereof is connected to the input terminal D6 to D0, respectively. Similarly, a voltage divider having series connected resistors R1 to R6, each of which has the same resistance value, is connected between the input terminal D0 of the multiplexer 202 and the ground, and each dividing point thereof is connected to the input terminals D0 to D6, respectively.

Each of the analog multiplexer 201 and 202 contains a decoder corresponding to the 3-bit inputs S4, S2 and S1, respectively. For example, when the inputs S4, S2 and S1 are (1, 0, 1), the input terminal D5 is selected, respectively. Hence, the multiplexer 201 supplies a voltage division output e2 from the output terminal OUT to an input terminal of a low-pass filter 22. While, the multiplexer 202 supplies a voltage division output e6 from the output terminal OUT to an input terminal of a low-pass filter 23. As described above, for the pan-pot data S4, S2 and S1 from the CPU 2, the multiplexers 201 and 202 are arranged in such a manner that they generate mutually complementary control voltages.

Figure 3:
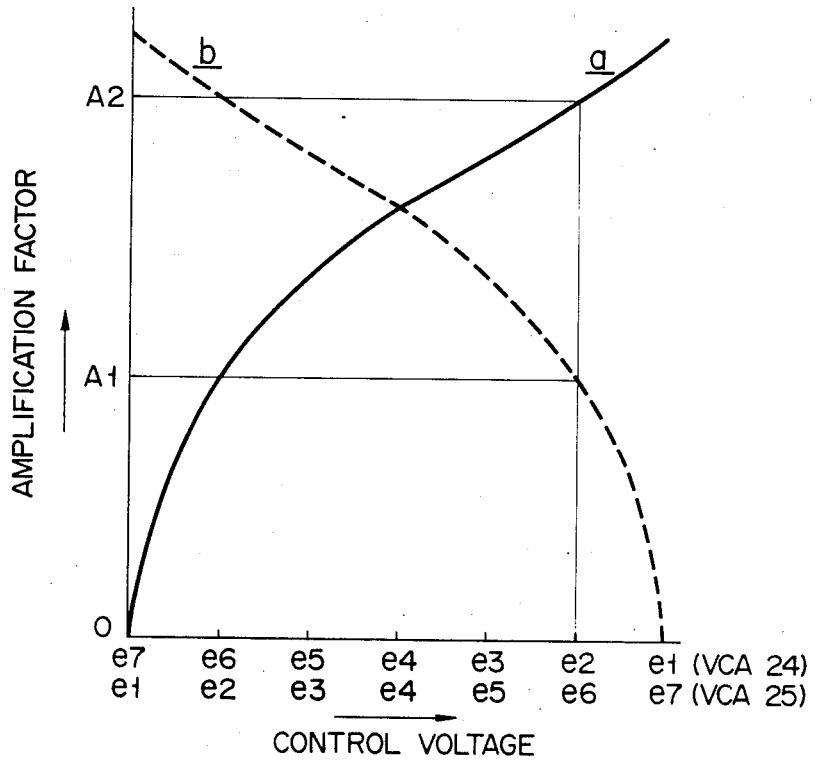
FIG. 3 is a graph showing the relationships between the control voltage and the amplification factor of the VCA used in the PAN-POT circuit in FIG. 1.

The voltages e2 and e6 at the dividing points which were selected by the multiplexers 201 and 202 are applied to the low-pass filters 22 and 23, where the noise components are eliminated; thereafter, they are supplied to control voltage input terminals CTs of VCAs (voltage controlled amplifiers) 24 and 25, respectively. The musical tone signal having a tone color of the piano from the filter 6 in FIG. 1 is supplied to input terminals IN of the VCAs 24 and 25, respectively. The amplification factors for the input control voltages of the VCAs 24 and 25 are set such that they change to the extent shown by the solid line a and the dashed line b of FIG. 3, respectively. Therefore, when the input control voltage level of the VCA 24 is e2, the amplification factor of the VCA 24 is A2. At this time, since the input control voltage level of the VCA 25 is e6 as has been described above, the amplification factor of the VCA 25 is A1. Thus, in other words, when the amplification factor of the VCA 25 changes as shown by the dashed line b, the amplification factor of the VCA 24 varies as shown by the solid line a. Therefore, the total volume of the musical sound generated from the loudspeakers 18 and 19 being heard is constant irrespective of the position of the sound image. In this case, it is possible to provide an electronic musical instrument having a pan-pot function in which the sound image position can be freely and securely set in accordance with the pan-pot data. The specific variations of various VCAs other than that shown in FIG. 3 can be compensated for by suitably setting the resistance values of the voltage dividing resistors R1 to R6, so that the outputs of the PAN-POT circuits 8 and 9 are not affected by the characteristics of VCAs. It is also possible to set the value of each of the resistors R1 to R6 such that when, for example, a control voltage e4 at which the sound image is localized at the center of the loudspeakers 18 and 19 is supplied to the VCAs 24 and 25, the output volume levels of the VCAs 24 and 25 become maximum instead of equalizing each value of the resistors R1 to R6. Due to this, if the piano sound image of large volume is localized at the center and the violin sound image of small volume is localized near the right loudspeaker 18, for example, the listener can hear the sound as if the piano sound was located in front of the central position between the loudspeakers 18, 19 and the violin sound was located near the right loudspeaker 18 and on the rear side of the piano sound. In this way, stereophonic pan-pot can be also realized.

The low-pass filters 22 and 23 shown in FIG. 2 include high-impedance buffers 22*a* and 23*a* that prevent the input voltage of the VCAs 24, 25 from being affected by the internal resistance (ON-state resistance) when the input terminals D0 to D6 of the analog multiplexers 201 and 202 are selected and the control voltages are output. Outputs of the buffers 22*a* and 23*a* are further smoothed by a smoothing circuit consisting of a resistor R and a capacitor C and then supplied to the VCAs 24 and 25. Due to this, the occurrence of so-called click sound can be prevented.

The pan-pot data output from the CPU 2 can be easily varied. For example, in an electronic musical instrument to which arpeggio effect can be applied, the sound is pleasant if the sound image is localized on the left side for small pitch sound and the sound image is gradually moved to the right as the sound pitch becomes large in relation to the change in arpeggio sound pitch. In this case, if data representing the relation between the arpeggio sound pitch and the corresponding pan-pot data has been preliminarily stored in the memory device 3 as a format of memory table, necessary pan-pot data can be easily obtained by sequentially accessing the memory device 3 by the CPU 2. In the same manner as described above, tremolo like and phase-shift like effects can be also applied by repeatedly and sequentially reciprocating the sound image location between the right and left loudspeakers and by changing its moving speed.

Although, in FIG. 1, the pan-pot has been executed with piano and violin tones, the number of musical sounds being executed may be set at any number. For example, an arrangement may be adopted wherein three different timbres are applied to the musical sounds obtained from three musical tone generators, respectively, with the sound images localized to the left, right and central locations respectively.

As described above, with the electronic musical instrument of the present invention, two sets of first and second volume control signals with a complementary relationship for one pan-pot data are obtained among a plurality of preset control signals; therefore, the pan-pot is not dependent on the characteristics of the volume variation means but can be freely and securely realized.

What is claimed is:

1. An electronic musical instrument having pan-pot means for generating musical sounds with pan-pot of the performed sounds in accordance with digital pan-pot data, the pan-pot means including:

control means including:

means for providing a plurality of preset pairs of first and second mutually complementary control signals, said control signal providing means including a reference voltage generator and first and second resistance type voltage division circuits for dividing a reference voltage generated from said reference voltage generator; and switching means coupled to said control signal providing means and including first and second analog multiplexers for selectively outputting pairs of said first and second mutually complementary control signals in a given sequence in accordance with said digital pan-pot, said selected pairs of first and second control signals always having a mutually complementary relationship, said first and second analog multiplexers each having a plurality of control signal input terminals, said pairs of control signals respectively generated from said first and second resistance type voltage division circuits being coupled to said plurality of control signal input terminals of the first and second analog multiplexers while maintaining said complementary relationship between said control signals, and said first and second analog multiplexers each also having digital control input terminals for receiving said digital pan-pot data;

first sound volume variation means controlled as a function of said first control signal to vary the sound volume of a musical tone; and second sound volume variation means controlled as a function of said second control signal to vary the sound volume of a musical tone;

said first and second sound volume variation means each including amplifier means having an amplification factor controlled by the respective control signals applied thereto, such that when said complementary control signals are applied at the same time to the respective amplifier means, the total musical sound produced and heard by a listener is substantially constant, irrespective of the pan-pot of the musical sound;

whereby a pan-pot of a sound performed in controlled in accordance with said first and second control signals by said pan-pot means.

2. An electronic musical instrument according to claim 1, wherein outputs of said first and second analog multiplexers are respectively coupled to control signal input terminals of said first and second volume variation means through first and second low-pass filters each containing a buffer.

3. An electronic musical instrument according to claim 1, wherein said first and second volume variation means comprise first and second voltage controlled amplifiers that have mutually similar characteristics of the control voltages versus the amplification factors thereof.

4. An electronic musical instrument according to claim 1, further comprising a key matrix circuit for delivering said pan-pot information, a CPU to which the pan-pot information applied from said key matrix circuit is supplied, said CPU outputting musical data, and first and second tone generator means for generating two kinds of musical tone signals in accordance with the musical data output from said CPU, wherein said pan-pot means includes first and second pan-pot circuits to which the outputs of said first and second tone generator means are supplied.

* * * * *